US006675624B2

(12) United States Patent
Naaktgeboren et al.

(10) Patent No.: US 6,675,624 B2
(45) Date of Patent: Jan. 13, 2004

(54) METHOD AND DEVICE FOR PRODUCING A DOUBLE-CURVED SHEET-LIKE OBJECT BY MEANS OF STRETCH-FORMING

(75) Inventors: Cornelis Arie Naaktgeboren, Barendrecht (NL); Cornelis Van Tilborgh, Hoofddorp (NL); Jacobus Jozef Vincentius Koning, Volendam (NL)

(73) Assignee: Fokker Aerostructures B.V., Barendrecht (NL)

( * ) Notice: Subject to any disclaimer, the term of this patent is extended or adjusted under 35 U.S.C. 154(b) by 0 days.

(21) Appl. No.: 09/916,119

(22) Filed: Jul. 26, 2001

(65) Prior Publication Data

US 2002/0062675 A1 May 30, 2002

Related U.S. Application Data

(63) Continuation-in-part of application No. 09/906,022, filed on Jul. 13, 2001.

(30) Foreign Application Priority Data

Jul. 13, 2000 (NL) ..... 1015708

(51) Int. Cl.[7] ..... B21D 11/02
(52) U.S. Cl. ..... 72/296
(58) Field of Search ..... 72/296, 297, 377, 72/302

(56) References Cited

U.S. PATENT DOCUMENTS

| | | | | | |
|---|---|---|---|---|---|
| 2,437,092 | A | * | 3/1948 | Greene | 72/296 |
| 2,676,638 | A | * | 4/1954 | Wheeler | 72/296 |
| 2,696,241 | A | | 12/1954 | Larsen | |
| 2,986,194 | A | * | 5/1961 | De Marco | 72/297 |
| 3,314,269 | A | | 4/1967 | Mackenzie | |
| 4,077,813 | A | | 3/1978 | Fletcher et al. | |
| 5,035,133 | A | | 7/1991 | White et al. | |
| 5,676,080 | A | * | 10/1997 | Allen | 72/296 |
| 6,272,897 | B1 | * | 8/2001 | Ciranna | 72/296 |

FOREIGN PATENT DOCUMENTS

| | | | | |
|---|---|---|---|---|
| CH | 356428 | * | 10/1961 | 72/296 |
| CH | 360045 | | 3/1962 | |
| DE | 745807 | * | 5/1944 | 72/297 |
| DE | 896184 | * | 7/1953 | 72/297 |
| FR | 1036632 | * | 9/1953 | 72/297 |

* cited by examiner

*Primary Examiner*—Daniel C. Crane
(74) *Attorney, Agent, or Firm*—Anthony H. Handal; Kirkpatrick & Lockhart LLP

(57) ABSTRACT

A device for forming a double-curved object comprises a frame, two elongate clamping heads which are arranged parallel to one another on the frame, a support with an exchangeable shaping die, on either side of which support there are clamping heads, and drive means for moving the clamping heads to and fro transversely with respect to their longitudinal direction, along the shaping die in the direction of a working stroke, during which the sheet is stretched and formed, and a return stroke. At least one of the clamping heads is provided with a double-curved shaping piece.

11 Claims, 2 Drawing Sheets

METHOD AND DEVICE FOR PRODUCING A DOUBLE-CURVED SHEET-LIKE OBJECT BY MEANS OF STRETCH-FORMING

CROSS-REFERENCE TO RELATED APPLICATIONS

This application is a continuation-in-part of U.S. patent application Ser. No. 09/906,022 filed: Jul. 13, 2001.

The invention relates to the manufacture of products from sheet material with a double-curved shape. The initially flat sheet material is stretched and drawn over a shaping die. During this process, the sheet material undergoes plastic deformation as a result of the combined action of the stretching and contact with the shaping die.

Usually, a process of this type is used for the production of metal objects, such as the leading edge of a wing, transition pieces for the transition between wing and fuselage, aircraft noses, etc. Shaped products of this type can also be used in the automotive industry.

During the production of double-curved objects, the stretching and forming has to be carried out in a relatively large number of separate steps. The reason for this is that the elongation in, for example, aluminium or steel sheet has to be kept within set limits. If these limits are exceeded, the quality of the product will suffer, for example as a result of the appearance of surface lines caused by the crystal structure of the sheet material being affected. Particularly in the case of products which are used in the bright, polished state, this leads to an unacceptable appearance.

In practice, therefore, the sheet material undergoes plastic deformation in small steps. After each shaping step the intermediate product obtained undergoes stress-relief annealing. After cooling, the intermediate product then has to be clamped in place again, be shaped one step further, released from its clamps again, annealed, cooled, etc.

A process of this type is laborious and labour-intensive. Moreover, it should be considered that a lubricant has to be applied to the shaping die before each shaping step, in order to counteract corrosion during shaping. The film of lubricant has to be removed before the intermediate product can be annealed.

Depending on the curvature of the end product and the maximum acceptable elongation in the material, the shaping process may take up several days, for example 3 to 4 days.

Therefore, if the number of steps in the shaping process could be reduced, it would be possible to make considerable savings in terms of production time and costs. A precondition is that the quality of the end product must not suffer when using a higher production rate.

The first object of the invention is to provide an improved method of this type. This object is achieved by means of a method for forming a double-curved object by means of stretching a sheet, comprising the steps of:

providing a shaping die with a shaped die surface, positioning the sheet in such a manner that it extends along the shaped die surface of the shaping die, clamping two opposite edges of the sheet into in each case one clamping head which extends along the respective edge, during a working stroke, moving the sheet with clamping heads and the shaping die towards one another, in such a manner that the sheet comes into contact with a part of the die surface which projects a relatively long way, and, as a result of continued movement of shaping die and clamping jaws, comes into contact with a part of the die surface which in relative terms does not project such a long way, influencing at least one clamping of the sheet in such a manner that a sheet edge section which is situated next to a part of the die surface which in relative terms does not project such a long way executes a greater advancing movement than a sheet-edge section which is adjacent to a part of the die surface which projects a relatively long way.

In the method according to the invention, the differences in elongation as arise in the sheet material remain limited on account of the use of one or more shaping pieces. These shaping pieces ensure that the sheet material is able to follow even the lower parts of the shaping die during stretching. This prevents those parts of the sheet material which bear against the higher parts of the shaping die from rapidly acquiring excessive elongation. On account of the use of the shaping pieces, therefore, the stretching process can be continued further for each deformation step without locally excessive elongation occurring and without the sheet material being damaged.

In this method, clamping heads which are known per se and comprise a pair of clamping jaws can be used. These clamping jaws each bear against one surface of the sheet. When carrying out the method, a flat sheet is clamped between the pairs of clamping jaws, and as a result of the contact between shaping die and sheet the sheet is bent around the clamping jaws which are situated on that surface of the sheet which is remote from the shaping die. Now, according to the invention, a shaping piece is attached to the said clamping jaw, or a shaped clamping jaw is used.

The use of a shaped clamping jaw or of a separate shaping piece only involves a minor intervention in the machine, which can be carried out without major problems.

The invention also relates to a device for carrying out the method as described above, comprising a frame, two elongate clamping heads which are arranged parallel to one another on the frame, a support with an exchangeable shaping die, on either side of which support there are the clamping heads, and drive means for moving the clamping heads to and fro transversely with respect to their longitudinal direction, along the shaping die in the direction of a working stroke, during which the sheet is stretched and formed, and a return stroke. According to the invention, at least one of the clamping heads is provided with a single-curved or double-curved shaping piece.

The shaping piece may be integrated in the clamping head or may be a separate component which is attached to the clamping head. Each clamping head comprises a pair of clamping jaws, at least one of the clamping jaws, which is situated at the rear in the direction of a working stroke, being provided with a shaping piece.

The shape of the shaping pieces is adapted to that of the shaping die. Since the shaping die comprises a part which in relative terms does not project such a long way in the opposite direction to the direction of the working stroke, at least one of the clamping heads must bear a shaping piece which, approximately at a position which is adjacent to the said part of the shaping die which in relative terms does not project such a long way, comprises a part which does project a relatively long way.

Although the above text speaks of a metal as the sheet material, for example aluminium or steel, the invention can also be used for sheet material made from plastics.

The invention will now be explained in more detail with reference to the highly diagramatic exemplary embodiment of the device according to the invention illustrated in the figures.

The device according to the invention for forming a double-curved object by means of stretching a sheet comprises two clamping heads 1, only one of which is shown. The clamping heads 1 run parallel to one another at the same height and are connected to a pivoting device which is known per se but is not shown and can be used to move the clamping heads 1 up and down.

A fixedly disposed stretching block 2, which is in the form of the curved object which is to be formed, is situated in the centre between the clamping heads 1.

Figure 1:
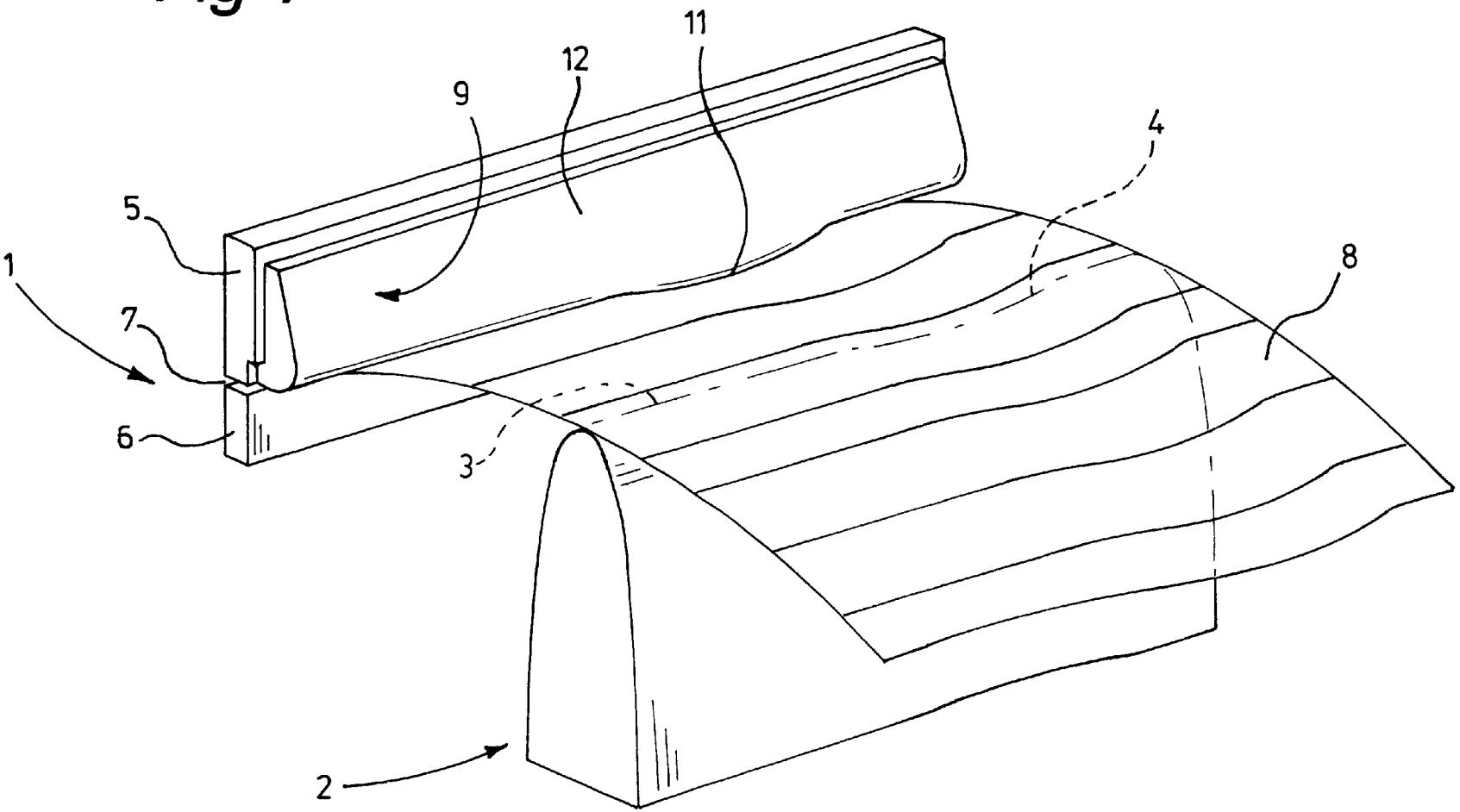
FIG. 1 shows a first step in the shaping of a sheet by means of the device according to the invention.

As is partially indicated by solid lines and partially by dashed lines in FIG. 1, this stretching block is in the form of a section of a nose profile for an aircraft wing. The stretching block 2 and the area of skin to be shaped for the nose profile have a single-curved section 3, which gradually merges into a double-curved section 4.

As is known, during the production of a double-curved sheet-like object by means of stretch-forming, the sheet-like material which is still straight is clamped over a stretching block and, in the process, is stretched slightly in order to be able to follow the curved contours of the stretching block. At the location of the double-curved sections of the stretching block, the plastic deformation which occurs is relatively great. Consequently, the stretching and the associated shaping of the sheet has to take place in a large number of separate steps according to the prior art. This is because the plastic deformation of the sheet material must remain within set limits. If these limits are exceeded, the crystal structure of the sheet material will be affected, leading to the appearance of surface lines.

To counteract this, the sheet material undergoes stress-relief annealing after every step in which plastic deformation occurs. Then, after cooling, the sheet material is clamped into the device again and is plastically deformed by a further, relatively small step, and so on until the final shape is obtained.

A procedure of this type is very labour-intensive, particularly with products which have a relatively pronounced double-curved shape. When shaping products of this type, it is necessary to pass through a large number of steps.

According to the invention, sheet-like products of this type can be shaped in a considerably smaller number of steps, without the drawbacks of the crystal structure being affected and the like arising.

The clamping heads 1 each comprise two clamping jaws 5, 6 which enclose a gap 7 in which the edge of the sheet 8 to be deformed is clamped. The opposite edge is correspondingly clamped in the second clamping head (not shown).

Figure 2:
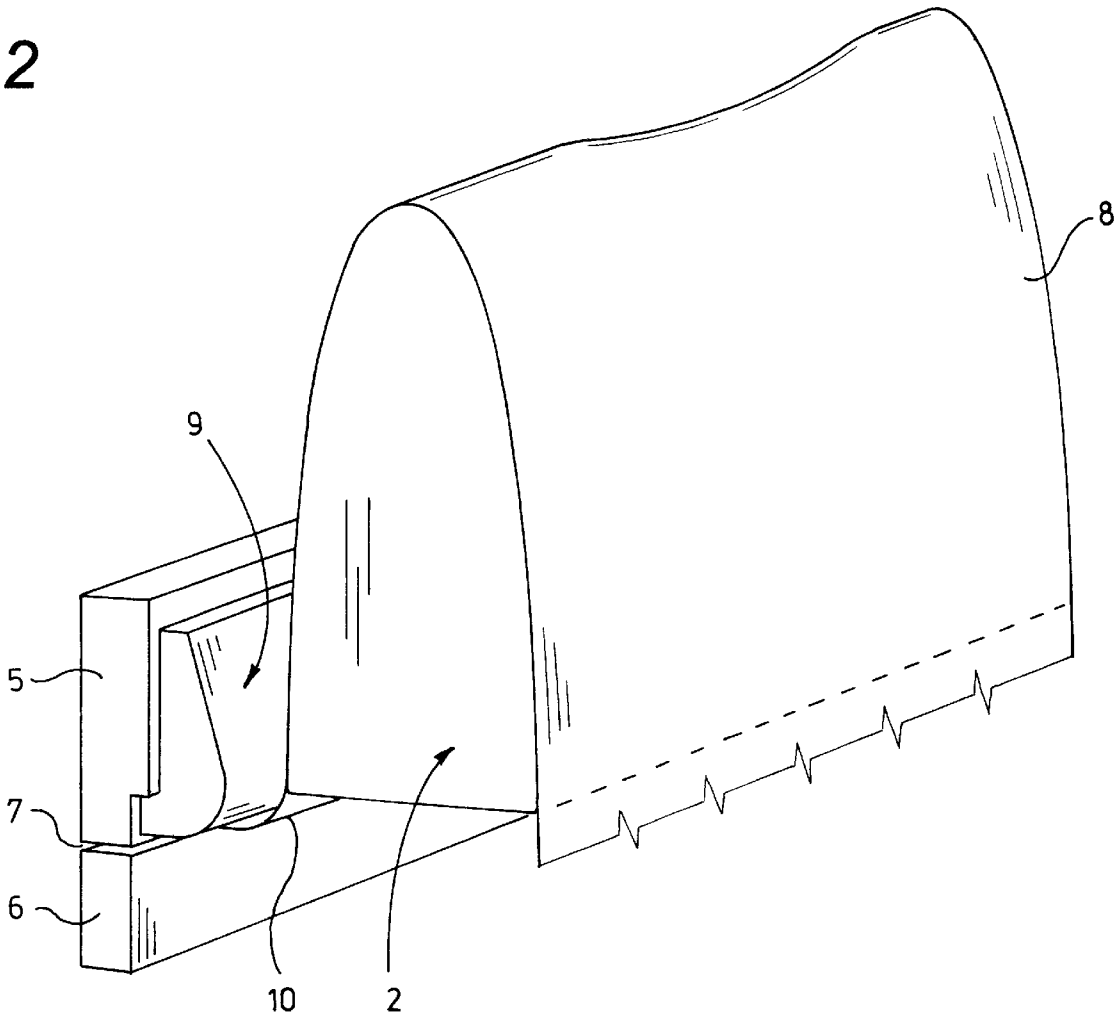
FIG. 2 shows a second step.

Moreover, the top clamping jaw 5 bears a shaping block 9, over which the clamped-in side of the sheet material 8 can curl with a uniformly curved section 10, as shown in FIG. 2.

The invention now uses a shaping block 9 which is not in the shape of a prism but which locally has a shaped section 11 which defines a cross section which deviates from the cross section of the prism-shaped part 12 of the shaping block. This shaped part 11, which likewise has a double curvature, is situated directly adjacent to the double-curved section 4 of the stretching block 2.

During the forming of the double-curved shape in the sheet material 8, the shaped section 11 of the shaping block 9 ensures that the sheet material, at the level of the double-curved section 4 of the stretching block, is able to follow the contour of this block even through relatively large deformation steps. The sheet material 8 also remains in good contact over the entire stretching block 2, since the sheet material 8 at the location of the shaped part 11 of the shaping block 9 is deformed further than at the location of the prism-shaped section 12 of the shaping block 9.

Consequently, the plastic deformation of the sheet material 8 can remain virtually uniform over the length of the stretching block 2, i.e. the plastic deformation at the location of the double-curved section 4 of the stretching block does not deviate excessively from that which is produced at the location of the straight section 3 of the stretching block 2.

Consequently, the maximum total elongation which is required in the product in order to achieve the desired deformation is much lower. As a result, the object can be produced in considerably fewer steps on the device, with a limited percentage elongation for each operation.

What is claimed is:

1. Method for forming a double-curved object by means of stretching a sheet, comprising:

a) providing a shaping die with a shaped die surface having a first part and a second part wherein the first part is a single curved section which gradually merges into the second part which is a double curved section;

b) positioning the sheet in such a manner that it extends along the shaped die surface of the shaping die;

c) clamping two opposite ends of the sheet into in each case one clamping head which extends along the full respective edge;

d) during a working stroke, moving the sheet with clamping heads and the shaping die towards one another, in such a manner that the sheet comes into contact with the second part of the die surface and as a result of continued movement of shaping die and clamping jaws, comes into contact with the first part of the die surface;

e) influencing at least one clamping of the sheet in such manner that a sheet edge section which is next to the first part of the die surface executes a greater advancing movement compared to a sheet-edge section which is adjacent to the second part of the die surface.

2. Method according to claim 1, further comprising the step of providing a shaping piece on at least one of the clamping heads, wherein said shaping piece bears against a sheet-edge section and imparts a greater advancing movement to this section.

3. Method according to claim 2, wherein the clamping heads comprise a pair of clamping jaws, wherein said clamping jaws each bear against one surface of the sheet, and further comprising clamping a flat sheet between the pairs of clamping jaws, bending the sheet around the clamping jaws which are situated on that surface of the sheet which is remote form the shaping die as a result of the contact between shaping die and sheet, and attaching a shaping piece to the said clamping jaw, or using a shaped clamping jaw.

4. A device for carrying out the method of claim 1 comprising:

a) a frame;

b) two elongate clamping heads arranged parallel to one another on the frame;

c) a support with an exchangeable shaping die, wherein on either side of said support there are clamping heads; and d) a drive means for moving the clamping heads to and fro transversely with respect to their longitudinal direction, along the shaping die in the direction of a working stroke, during which the sheet is stretched and formed, and a return stroke, characterized in that at least on of the clamping heads is provided with a double-curved shaping piece.

5. Device according to claim 4, wherein the shaping piece is integrated in the clamping head.

6. Device according to claim 4, wherein the shaping piece comprises a separate component mounted on the damping head.

7. Device according to claim 4 wherein the shaping piece is integrated in a shaping block attached to the clamping head.

8. Device according to claim 4 wherein each clamping head comprises a pair of damping jaws and at least one of the clamping jaws is situated at the rear in the direction of a working stroke, and is provided with a shaping piece.

9. Device according to claim 4 wherein the shaping die comprises the first part wherein the first part extends a fixed first length in the opposite direction to the direction of the working stroke, and wherein at least one of the clamping heads is provided with a shaping piece wherein approximately at a position adjacent to the first part said shaping piece comprises a part extending a length greater than said first length.

10. A device according to claim 4 further comprising a shaping piece on at least one of the clamping heads, wherein said shaping piece bears against a sheet-edge section.

11. A method for forming a double-curved object by means of stretching a sheet, comprising:

a) providing a shaping die with a shaped die surface having a first part and a second part;

b) positioning the sheet in such a manner that it extends along the shaped die surface of the shaping die;

c) clamping two opposite ends of the sheet into in each case one clamping head which extends along the full respective edge;

d) during a working stroke, moving the sheet with clamping heads and the shaping die towards one another, in such a manner that the sheet comes into contact with the second part of the die surface wherein said second part projects a fixed distance of a first length relatively long way, and as a result of continued movement of shaping die and clamping jaws, comes into contact with the first part of the die surface wherein the first part projects a fixed distance having a length less than the first length which in relative terms does not project such a long way;

e) influencing at least one clamping of the sheet in such a manner that a sheet edge section which is next to the first part of the die surface which in relative terms does not project such a long way executed a greater advancing movement compared to a sheet-edge section which is adjacent to the second part of the die surface which projects a relatively long way, wherein the part of the sheet coming into contact with the first part is prevented from acquiring locally excessive elongation, wherein the first part is a single curved section which gradually merges into the second part which is a double curved section.

* * * * *